US008359726B2

(12) United States Patent
Ansorge

(10) Patent No.: US 8,359,726 B2
(45) Date of Patent: Jan. 29, 2013

(54) METHOD FOR SETTING UP A PAINTING SYSTEM IN A PREDEFINED SETUP LOCATION

(75) Inventor: Helmut Ansorge, Feuchtwangen (DE)

(73) Assignee: Rehau AG + Co, Rehau (DE)

( * ) Notice: Subject to any disclaimer, the term of this patent is extended or adjusted under 35 U.S.C. 154(b) by 424 days.

(21) Appl. No.: 12/671,212

(22) PCT Filed: Aug. 8, 2007

(86) PCT No.: PCT/EP2007/007009

§ 371 (c)(1),
(2), (4) Date: Jan. 29, 2010

(87) PCT Pub. No.: WO2009/018841

PCT Pub. Date: Feb. 12, 2009

(65) Prior Publication Data

US 2010/0186664 A1 Jul. 29, 2010

(51) Int. Cl.
*B21B 1/46* (2006.01)
*B05B 15/12* (2006.01)

(52) U.S. Cl. ..... 29/527.1; 118/300

(58) Field of Classification Search ..... 29/428, 29/429, 527.1, 711, 783; 118/300
See application file for complete search history.

(56) References Cited

U.S. PATENT DOCUMENTS

2004/0225391 A1* 11/2004 Fromherz et al. ..... 700/97

FOREIGN PATENT DOCUMENTS

| | | |
|---|---|---|
| DE | 195 41 409 | 5/1997 |
| DE | 199 57 607 A 1 | 5/2001 |
| DE | 10 2004 056 493 | 1/2006 |
| DE | 10 2004 060 515 | 1/2006 |
| WO | WO 2007/090538 | 8/2007 |

OTHER PUBLICATIONS

International Search Report, Oct. 14, 2008.

* cited by examiner

*Primary Examiner* — John C Hong
(74) *Attorney, Agent, or Firm* — Da Vinci Partners LLC

(57) ABSTRACT

The invention relates to a method for setting up a painting system (22) in a predefined setup location (20), wherein the painting system (22) comprises at least one module group (26, 28, 30), which is provided for a work step and which further comprises a number of modules (16, 16', 16', 16") that are functional per se, which contribute to performing the work step, and wherein each module (16, 16', 16', 16") has components (14, 14', 14', 14") specific to the module, wherein in a first step preferably each module (16, 16', 16', 16") of the module group (26, 28, 30) is completed in a finishing location (10), in a second step each module (16, 16', 16', 16") of the module group (26, 28, 30) is transported to the setup location (20), and in a third step the painting system (22) is set up by connecting all modules. The invention further relates to a painting system (22).

21 Claims, 2 Drawing Sheets

METHOD FOR SETTING UP A PAINTING SYSTEM IN A PREDEFINED SETUP LOCATION

This application is the National Stage of International Application No. PCT/EP2007/007009, filed Aug. 8, 2007.

BACKGROUND OF THE INVENTION

The present invention relates to a method for setting up a painting system at a specified setup location.

Painting systems for components, such as those used in large numbers and in high-quality applications in automobile manufacturing, for example, are complex production facilities with high capital costs. Such painting systems are generally constructed to be set up in a building, and frequently are adapted to the space constraints of the building. As a result, provision of individual processing zones within the system is complicated and resource-intensive, because their design is modified to the local circumstances of the building.

Such painting systems are planned and constructed according to given specifications, including the sequence and number of process steps, painting steps, pre- and postprocessing steps, the logistical system for the components to be painted, and the supply of power and media to the system. If such a known painting system is to be expanded or otherwise modified because, for example, the specifications for the components to be painted have changed, this entails high costs, severe impediments, and other undesireable compromises. Viewed overall, such retrofitted painting systems of this type therefore are often disadvantageous, because changes to the system do not always correspond to what is required by a changed process specification. It is often necessary to make compromises, which complicate the painting and pre- and postprocessing operations, such compromises seldom being fully satisfactory. The degrees of freedom of a painting process are sometimes restricted in certain respects rather than being expanded so as to yield an improved process.

Modifications of existing painting systems, such as those often used, for example, by automobile manufacturers and in particular automotive part suppliers, are complicated, expensive, and cumbersome, and can be carried out only in specific time windows due to the interference with the continuous painting operation, and therefore should be avoided whenever possible.

A further disadvantage of the above-described painting systems is that they are designed to be modified at the setup location. Moving such a painting system to another location is therefore very complicated and sometimes impossible, because disassembly of the individual modules, transfer to a new location, and assembly to produce an operable painting system involve great difficulties.

Although painting systems for large molded parts are currently designed and constructed in modules, the primary focus is reduction in the complexity of design, in each case with regard to the individual modules of a painting system (washing machine, evaporation zone, dryers, booths, ventilation systems, etc.). The individual parts/modules are transported to the destination and assembled at that location. As a rule, this also includes the complete piping system for water, wastewater, and energy supplies such as electrical power, gas, compressed air, etc. This requires the costly use of specialty contractors at the construction site, who perform test runs and make improvements as needed after installation is completed. In this regard, the installation operations sometimes take place in parallel, to the extent possible, and sometimes they must be performed in succession.

For many different types of trades, specialty contractors must be used for long periods at the construction site. Only after installation by such tradesmen can test runs be started in order to test the function of the individual process groups, which is generally followed by improvement and optimization activities. In addition to staffing capacity, the specialty contractors must also provide a large amount of lifting and transport equipment, special tools, and machines at the construction site. For this reason, the entire installation and start-up usually takes several months. For the operator, there is the additional risk that undetected defects may adversely affect the production quality, or that deadlines are not met.

Object of the Invention

The object of the present invention, therefore, is to provide a method for setting up a painting system at a specified setup location, by means of which the time and expense for setting up or constructing the painting system at the setup location may be greatly reduced in comparison to known approaches.

Achievement of the Object by the Invention

This object is achieved according to the invention by use of a method for setting up a painting system at a specified setup location, wherein the painting system is provided for painting components by use of a painting process which includes at least one process step, the painting system comprising at least one module group which is provided for the process step, and also having a specified number (equal to or greater than one) of modules which are functional as such and which are specific to the module group, and which contribute to performing the process step, and wherein each module has components which are specific to the module, whereby, in a first step, at least one, preferably each, module of the module group is completed at a particular finishing location that is spatially separate from the setup location, and after final assembly of a particular module, all distinct components of this module are combined into the module and the module is functional as such, and in a second step, each module of the module group is transported to the setup location, and in a third step, the painting system is set up by providing the module group at the setup location by connecting all modules of the module group. The term "functional as such" means that after final assembly of an individual module, functional testing is possible at the particular finishing location. Replaceable parts, for example filters, filter inserts, or atomizers on a painting robot are fully assembled, for example, only at the setup location.

A painting system composed of at least one module group is provided according to the invention. The painting system may comprise a complete painting process or only parts thereof, for example preparation (activation of surfaces to be painted, etc.) and/or postprocessing (for example, polishing, spot repair, etc.). The module groups, which in each case comprise modules which are functional as such, according to the invention each perform at least one process step in the overall painting process.

Each module which is functional for its particular purpose contributes to performing the process step provided for the overall module group, and for this purpose has corresponding module-distinct components. According to the invention, before the painting system is constructed or set up at a specified setup location, for example in the vicinity of an automobile manufacturing site, at least one, preferably each, module of the module group is completed at a particular finishing location, and after final assembly of a particular module all distinct components of this module are combined into the module and the module is functional for its particular purpose. After final assembly, the modules which are functional for their particular purpose are designed according to the invention in such a way that the function or the capacity to perform is already achieved within the scope of the contribution of the particular module to the process step. Thus, for example, an overall module group in the form of a paint booth which is provided for a process step may have, among other things, a module which is functional for its particular purpose in the form of a booth module or painting function module and a spray mist separator function module, wherein distinct components of the booth module include, among other things, a booth wall, booth floor, filter ceiling, painting robot which is mounted on the booth wall or booth floor, for example, a paint supply, robot control system, booth control system, conveyor system, and booth lighting. Distinct components of the spray mist separator function module include, among other things, a separator system, air circulation system, cold and hot water supply, and a control section. The overall paint booth module group is then obtained from, for example, four additional such modules which are functional for their particular purpose, for example a module in the form of a clean room section having a floor and ceiling, as distinct components. To provide modules which are functional for their particular purpose, according to the invention all piping, cabling, and other equipment necessary for operation is preinstalled. The modules are dimensioned so that they may be easily transported, for example by road, rail, or ship.

The functional preassembled modules are then transported to the planned setup location, where they are connected to one another to set up the module group. According to the invention, for start-up at the planned setup location, only the individual modules which are already functional or usable are then supplied with necessary media and power from media and power sources located at the setup location, via media lines or media connections and power lines, wherein for this purpose, at least one of the modules preferably has, among other things, module-distinct components in the form of connecting elements for connecting the module to the media lines or power lines.

Furthermore, because all media connections and power lines are established using quick-connect couplings, preferably having a foolproof design, there is little or no need for specialty contractors, thereby greatly reducing the level of effort for coordination and start-up. Time-consuming correction of defects is likewise eliminated according to the invention. According to the invention, it is necessary only to perform only slightly laborious connection operations, in particular for connecting the modules to the particular module group. Complicated installation activities are eliminated according to the invention, because modules functional for their particular purpose are already connected to the particular module group.

In particular, according to the invention, the risk of not meeting deadlines and quality levels possibly agreed to with customers is greatly reduced, because the modules may be successfully started up at the finishing location, and as a result of the modular design, any defective module may be quickly and easily replaced by a functional module.

Advantageous Refinements of the Invention

In one advantageous refinement of the invention, the painting process comprises multiple process steps which are carried out according to a specified sequence, and the painting system comprises multiple module groups, each module group being provided for at least one of the process steps, and in the third step, the painting system is set up by the fact that each module group is provided by connecting all modules of the module group, and all provided module groups are connected to one another to ensure the specified sequence of the process steps. According to the invention, by use of this method a completely modular painting system, which, in addition to the actual painting, may also include a number of further process steps, for example cleaning or drying of components that are painted or to be painted, may be set up at a specified setup location, in particular with a greatly reduced level of effort compared to known approaches, as described above.

In one advantageous refinement of the invention, before final assembly at the finishing location, which preferably is an assembly hall or assembly room, at least one of the modules is partially assembled at at least one installation location, which may be or is spatially separate from the finishing location according to the invention, wherein the installation location also is preferably an assembly hall or assembly room. Thus, the setup of the painting system according to the invention may also be adapted to circumstances for which partial preassembly is necessary or advantageous.

The finishing locations for at least two modules are preferably identical, and in one particularly practical refinement of the invention, the finishing locations for all modules are identical.

In a further practical refinement of the invention, for at least one of the assembled modules, the module is tested for functionality between the second and third steps. According to the invention, this is preferably carried out after the media and power supply, provided or required for the particular module, is provided. In this manner, possible sources of error may be identified and eliminated before transport to the setup location.

During the third step, each module group is preferably connected to at least one additional module group, particularly preferably detachably connected, to allow in particular simple and practical disassembly of the module group, and thus also of the entire painting system, after final assembly or termination of painting operations at the setup location. The connection may preferably be established by use of connecting means by which the individual module groups may be connected in a positive-fit or form-fit manner. According to the invention, such connecting means may also be provided for connecting the individual modules of a module group to the module group.

According to the invention, the modules or module groups may thus also be easily separated from one another, thus greatly simplifying moving of the painting system. In particular, the disassembly costs are also drastically lowered, as well as the costs for media supply lines and power lines, which for prior art system designs are generally discarded.

The invention further relates to a painting system for painting components, preferably polymeric components, for example automotive bumpers, by use of a painting process which includes at least one process step, the painting system comprising at least one module group which is provided for the process step, the module group having a specified number of modules which are functional for their particular purpose and which are specific to the module group, and which contribute to performing the process step, the painting process preferably comprising multiple process steps which are carried out according to a specified sequence, and the painting system preferably comprises multiple module groups, wherein each module group is provided for at least one of the process steps, and the module groups are connected to one another to ensure the specified sequence of the process steps.

The painting system according to the invention, which preferably may be set up at a specified setup location using the method according to the invention, comprises modules which are functional for their particular purpose. According to the invention, a painting system is provided which may be set up without the need for major installation activities, because modules that are already functional are present which according to the invention are designed in such a way that the function or the capacity to perform the function is already achieved within the scope of the contribution of the particular module to the process step. The activities to be performed for setting up the painting system, as described above, are limited to simple, fairly uncomplicated connection operations, along with a great reduction in the costs for setting up the painting system.

For disassembly, modification, or retrofitting of the painting system, the modules may easily be individually replaced essentially without having to change the structure of the painting system, for example for changed painting specifications or to correct malfunctions of a module. However, retrofitting may also be performed, for example for new, more advanced technology, without great effort by exchanging the particular module for one with appropriate features.

The process steps of the painting process provided for individual module groups may be as follows, for example:

Component work order,
Component cleaning,
Component drying,
Surface activation of components (flame treatment, plasma activation, and the like),
Component inspection,
Masking of given surface regions of a component,
Blowing of components with ionized air,
Cooling of components,
Application of a first coat of paint to the component surface,
Evaporation of the first coat of paint,
Drying/baking of the first coat of paint,
Cooling of components,
Application of a second coat of paint to the component surface,
Evaporation of the second coat of paint,
Drying/baking of the second coat of paint,
Cooling of components,
Application of a third coat of paint to the component surface,
Evaporation of the third coat of paint,
Drying/baking of the third coat of paint,
Cooling of components,
Inspection/quality testing of the painted components,
Repair/finishing of the painted components,
Demasking of the painted components, and/or
Component acceptance.

The modules of a module group are preferably interconnected according to a module plan which is specific to the module group and which preferably may be adapted to given painting projects or painting processes.

In one particular refinement of the invention, each module has components which are specific to the module, and in one practical refinement of the invention, for at least one module of each module group, at least one distinct component is provided in the form of a container, wherein the container has an interior space in which additional distinct components of the module are installed. Each module of each module group preferably has a distinct component in the form of a container, wherein each container of a module is connected in a force-fit manner to at least one additional container of a module of the same module group. The individual module groups can also be interconnected in this manner.

The connection may be established by use of tensioning devices, screw connections, clamping devices, and similar means. It is thus possible to provide additional containers on and next to containers connected in this manner, wherein the configuration of a plurality of containers thus results in a stable module group or a painting system composed of a number of module groups which, in contrast to painting systems according to the prior art, requires no further support means in the form of scaffolding, support structures, galleries, substructures, or the like. According to the invention, instead of a container, any other intrinsically stable apparatus, for example a booth, may be provided for installing or suitably housing distinct components.

In a further practical refinement, the interior space of the container is delimited by container walls, and in at least one container wall at least one passage opening is provided for the passage of at least one line which extends from the interior to outside the container. The passage opening may be provided in container side walls or a base or top wall of the container, and is provided, for example, for passing through power lines, media lines, data transmission lines, data transmission cables, hydraulic hoses, or the like.

Preferably used as the starting basis for the containers are so-called sea containers, which are used worldwide as a standard for the transport of freight and goods of any type. These containers are used in large numbers for freight transport by sea, rail, and road. As a result of worldwide use, logistical facilities for such containers are available at many locations or are easily provided with support from logistics companies. Containers of the described type are used not only for goods and freight transport, but also, for example, for providing temporary or permanent office or residence space having a modular design, as is often the case at major construction sites. Containers of this type have a number of advantages: they have a stable frame structure, are constructed worldwide with standardized dimensions, and the design and size are standardized. The containers have means for performing loading on trucks, railcars, and ships according to standardized procedures, and the required loading equipment is available worldwide.

If basic technical conditions such as the size of modules or components or necessary room sizes do not permit use of these standard containers, the modules, i.e., functional modules, are constructed on a custom basis so that they can still be transported. In addition to integrated process functionality, the necessary intrinsic stability for transport and also use at the setup location is taken into account without additional steel structures.

The containers are generally provided with a pair of folding doors on at least one end face or side wall to allow access to the interior of the container. In order to design a painting system within the meaning of the inventive concept, composed of modules which have such containers as an essential distinct component, and in which the containers for the modules are put together in a predetermined manner, in most cases these containers are supplemented with an additional opening at the end face, opposite from the folding doors. In certain cases it may also be advantageous to provide openings in longitudinal walls of the container.

It is advantageous to provide sealing means between every two containers to be connected or coupled to one another to ensure shielding of the processing area inside the containers from external effects in the form of dust, outside air, etc. In this regard, means may be provided to establish a pressure-tight connection between two mutually connected containers;

these means may be sealing systems, sealing frames, sealing packages, or sealing cushions or cords or the like. By use of these means, a work space is provided in the connected containers in which an air pressure differential must be maintained with respect to the outside environment. This is particularly critical for air flow inside a painting system.

In one practical refinement of the invention, the distinct components are installed inside the container according to a specified component plan.

In a further refinement of the invention, for at least one module of each module group, a number of the distinct components are provided in the form of electrical and/or pneumatic and/or hydraulic and/or data processing and/or fluid-conducting components which form a module-specific infrastructure.

This may include components which, for example in the form of means, are designed to provide electrical energy, record data, transmit data, process data, and/or conduct, distribute, and/or condition gases.

In one practical refinement of the invention, connecting means are provided which are designed to connect the infrastructure of one module group to the infrastructure of at least one other module group. For this purpose, the module groups or modules have connecting means for data transmission networking. This may include a data bus, although connecting means may also be used to ensure networking via wireless data transmission; these may be wireless-based systems or systems based on other frequencies of electromagnetic radiation. The rapid setup of the connections is advantageous for the latter. According to the invention, production and quality data collected in the processing of components during the painting process may be exchanged between the individual module groups in order to advantageously control the overall component painting process.

In one advantageous refinement of the invention, transmission means are provided which are designed to transfer energy and/or media and/or signals and/or data between at least two module groups.

For this purpose, the modules or module groups may advantageously have standardized interfaces at which the transfer of energy and/or media and/or signals and/or data occurs; these may include electrical and/or electronic interfaces and lines used for fluid conduction.

For this purpose, the modules or also the module groups may be interconnected or networked for the exchange of media, which may include, for example, water, compressed air, painting materials and associated auxiliary materials such as hardeners, diluents, cleaners, etc., air for drying purposes (heated, dehumidified, purified, etc.), steam, and heat transfer media (heated oil, or water, or other liquids as well as gases).

In this regard it is particularly advantageous when the interfaces for transferring energy and/or media and/or signals and/or data are designed as plug-in connections in the form of quick-connect couplings, which may be advantageously used for rapid coupling, and thus, quick start-up of the painting system.

To avoid mix-ups where multiple connections are required for a medium, for example, coded quick-connect couplings may be used.

The modules may then be coupled without the use of specialists, and a "plug and paint" approach may thus be implemented according to the present invention.

As module-distinct components, it is also possible to provide sensors which record signals and/or data and transmit the same to the transfer means. The signals and/or data generated by the sensors may provide information, in particular those concerning parameters of the painting process.

The modules or module groups may have control devices as distinct components. The control devices may be designed in the form of a PC, with input of data provided by sensors and output of data sent to actuators. The control devices for the individual modules or also for the individual module groups may be networked, thus being controllable from a central location in the system. This has advantages for operation of the system, because all relevant data which characterize the operating state of the system and which are critical for the production or painting of components in the system are available from one location. The data are compiled at this central location, where the data may be displayed, and from there interventions based on the available data may be made in the individual modules having the distinct components implemented therein, in particular in the form of actuators.

In one practical refinement of the invention, the painting system has seven modules, comprising a module group which may be used as a washing zone or preferably also as a cleaning and activating zone, a module group which may be used as a paint booth, a module group which may be used as an evaporation zone, a module group which may be used as a drying zone, a module group which may be used as a cooling zone, a module group which may be used as an inspection zone, and a module group which may be used as a postprocessing zone.

A module group which may be used as a washing zone comprises, among other things, modules having the following distinct components:

Means for supplying and discharging water, sensors for pressure, temperature, washing agent concentration, pH of the washing liquid and other necessary aqueous media, and sensors for the air temperature, air pressure, and air motion. Alternatively, according to the invention, the cleaning may be performed using $CO_2$ pellets or $CO_2$ snow.

A module group which may be used as a paint booth zone comprises, among other things, modules having the following distinct components: means for supplying and discharging air, at least one painting robot, means for supplying paint, a cleaning device for a paint application device, and sensors for air temperature, air pressure, relative humidity, particles in the air, and air motion in the processing room.

A module group which may be used as a drying zone comprises, among other things, modules having the following distinct components: means for supplying and discharging air, IR radiation sources, and sensors for air temperature, air pressure, relative humidity, particles in the air, and air motion in the processing room.

A module group which may be used as a cooling zone comprises, among other things, modules having the following distinct components: means for supplying and discharging air, sensors for air temperature, air pressure, relative humidity, particles in the air, and air motion in the processing room, and temperature sensors for measuring the surface temperature of the components.

A module group which may be used as an inspection zone comprises, among other things, modules having the following distinct components: means for supplying and discharging air, means for lighting, and sensors for air temperature, air pressure, relative humidity, particles in the air, and air motion in the processing room.

A module group which may be used as a postprocessing zone comprises, among other things, modules having the following distinct components: means for supplying and discharging air, means for lighting, and sensors for air temperature, air pressure, relative humidity, particles in the air, and air motion in the processing room.

BRIEF DESCRIPTION OF THE DRAWINGS

One exemplary embodiment of the method according to the invention is explained in greater detail with reference to the accompanying drawings, which show the following:

FIG. 1 shows a schematic illustration for explaining the method according to the invention. In a first step S1 individual distinct components of a module 16, comprising a container 12 and additional distinct components 14 (see top illustration for step S1), are assembled into a module 16 (see bottom illustration for step S1) at a finishing location 10. For this purpose, all further components 14 are preferably installed in the interior of the container 12. All further modules of all module groups of the painting system to be set up are likewise assembled analogously to step 1 [sic; S1], using respective distinct components.

FIG. 1 illustrates the situation in which all components 12 and 14 are assembled to form the module 16 at the finishing location 10, which preferably is an assembly hall. According to the invention, however, before final assembly at the finishing location 10, the module 16 may also be partially assembled (not shown) at an installation location that is separate from the finishing location 10.

Figure 1:
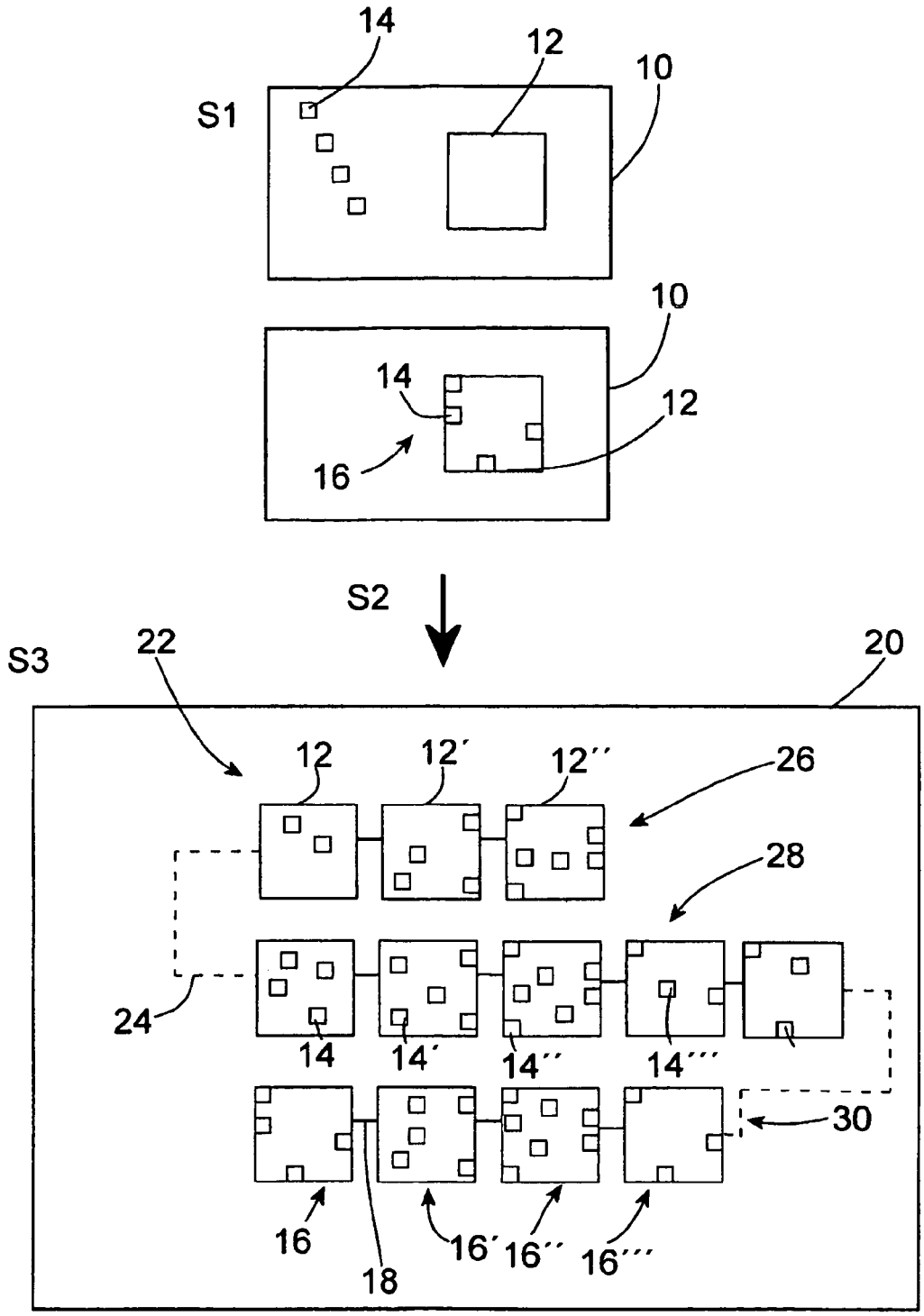
FIG. 1 shows a schematic illustration for explaining the method according to the invention.

After assembly, the module 16 is functional for its particular purpose, in particular in such a way that the function or the capacity to perform is already provided within the scope of the contribution of the particular module to the process step, wherein, for example, a module in the form of a painting module or painting function module (not shown) may have, among other components, booth walls, a booth floor, filter ceiling, painting robot, paint supply, robot and booth control systems, conveyor system, and booth lighting as distinct components. If necessary, a clean room section having a floor and ceiling is also integrated as a further distinct component, wherein all piping, cabling, and other equipment necessary for operation is likewise preinstalled, resulting in a module that is functional for its particular purpose.

After assembly of all modules provided for setting up the painting system, in a second step S2, these modules are transported to a planned setup location 20, where the third step S3, namely, setting up the painting system 22 according to the invention, is carried out, in which assembled modules 16, 16', 16", and 16''' are first interconnected to form module groups 26, 28, and 30 (see schematic connection lines 18), which in each case are provided for at least one process step in the overall painting process. In addition, module groups 26, 28, 30 thus provide for ensuring a specified sequence of process steps of the painting process are interconnected (see schematic connection line 24).

The connections 24 of module groups 26, 28, 30, and preferably also the connections 18 of the individual modules to form the module groups also include, in addition to a mechanical connection of module groups 26, 28, 30 or modules 16, 16', 16", and 16''' to be established, the connection of the infrastructures thereof, as well as the connection of module groups 26, 28, 30 or modules 16, 16', 16", and 16''' via transfer means which are designed to transfer energy and/or media and/or signals and/or data between module groups 26, 28, 30 or modules 16, 16', 16", and 16''' (not shown). A connection is also provided to a suitable power and media supply (not shown) at the setup location 20. According to the invention, most, preferably all, of the connections to be established are made via quick-connect couplings, so that the module groups or modules may be coupled without the use of specialists. Thus, a practical and economical "plug and paint" approach is realized according to the invention.

Because the individual modules 16, 16', 16", and 16''' at the setup location 20 are already functional for their particular purpose, the activities for setting up the painting system 22 at the setup location 20 are limited to the described, easily performed connection operations. Complex installation operations at the setup location 20, which are the case in known approaches, are eliminated, accompanied by markedly reduced costs and great flexibility in the use of the painting system 22 at the specified setup locations 20.

Figure 2:
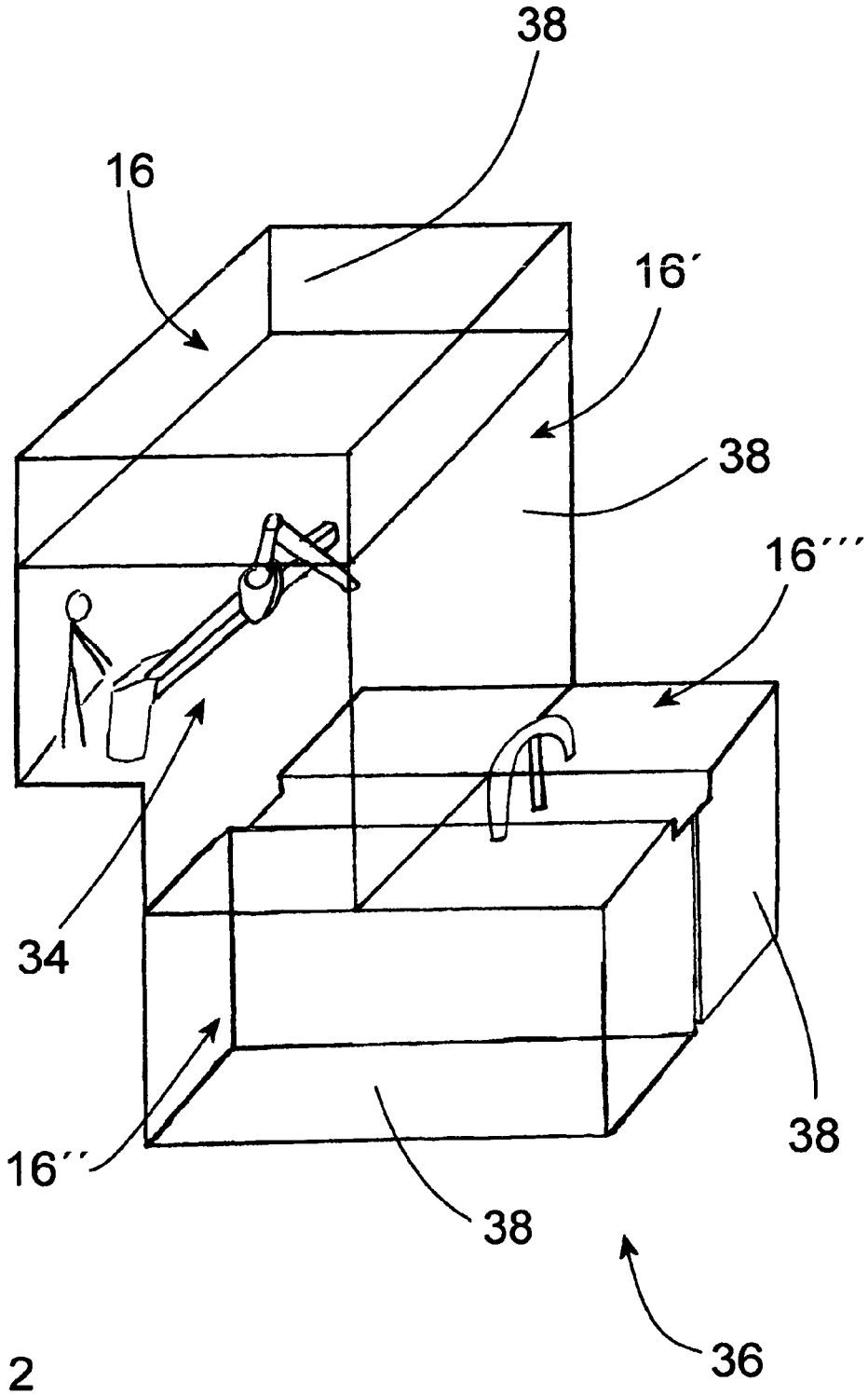
FIG. 2 shows a diagram of multiple interconnected modules of a module group in the form of a paint booth module group.

FIG. 2 shows a diagram of multiple interconnected modules of a module group in the form of a paint booth module group 36.

The paint booth module group 36 includes, in addition to further modules which are functional for their particular purpose (not shown here), in particular modules in the form of an air distribution function module 16, in the form of a painting function module 16', and in the form of two spray mist separator function modules 16", 16'''. All modules 16, 16', 16", and 16''' have as distinct components respective booths 38, preferably in the form of containers, which are mechanically connected to one another, and inside of which further distinct components are housed. The booths 38 for the spray mist separator function modules 16", 16''' have a length of up to 12 meters. The height of these booths is within a range of approximately 3 to 4 meters, and the height is preferably approximately 4 meters; the width of these booths is within a range of approximately 4 to 5 meters, and the width is preferably approximately 4.5 meters. These dimensions according to the invention, which preferably may also be provided for other modules, allow the modules to be transported without special cost-intensive measures, which are necessary for devices having larger dimensions.

The painting function module 16' has as distinct components, among other things, a filter ceiling, a painting robot 34 which is mounted on the booth wall or booth floor, for example, a paint supply, a robot control and booth control system, a conveyor system, and booth lighting (not shown). The spray mist separator function modules 16", 16''' have as distinct components, among other components, a separator system, an air circulation system, a cold and hot water supply, and a control section (not shown).

The painting system described in the exemplary embodiment is particularly suited for the painting of automotive parts such as bumpers and the like. This has the advantage that, for example, for a specific production series of a vehicle, such a painting system may be set up in the immediate vicinity of the vehicle production, and after the vehicle series ends, may optionally be moved to another location. However, it is also possible to use the teaching according to the invention for painting of components outside the automotive manufacturing sector.

List of Reference Numerals

| | |
|---|---|
| 10 | Finishing location |
| 12, 12', 12", 12''' | Container |
| 14, 14', 14", 14''' | Distinct component |
| 16, 16', 16", 16''' | Module |
| 18 | Connection |
| 20 | Setup location |
| 22 | Painting system |
| 24 | Connection |

-continued

| List of Reference Numerals | |
|---|---|
| 26, 28, 30 | Module group |
| 34 | Painting robot |
| 36 | Paint booth module group |
| 38 | Booth |

The invention claimed is:

1. Method for setting up a painting system at a specified setup location, wherein the painting system is provided for painting components by use of a painting process which includes at least one process step, wherein the painting system comprises at least one module group, which is provided for the process step and which further comprises a specified number of modules which are functional for their particular purpose and which are specific to the module group, and which contribute to performing the process step, and wherein each module has components which are specific to the module, whereby in a first step at least one module of the module group is completed at a respective finishing location that is spatially distinct from the setup location, and after final assembly of a particular module, all distinct components of this module are combined into the module and the module is functional for its particular purpose, in a second step each module of the module group is transported to the setup location, and in a third step, the painting system is set up by providing the module group at the setup location by connecting all modules of the module group.

2. Method according to claim 1, wherein the painting process comprises multiple process steps which are carried out according to a specified sequence, and the painting system comprises multiple module groups, each module group being provided for at least one of the process steps, and in the third step the painting system is set up when each module group is provided through the connection of all modules of the module group, and all provided module groups are connected to one another to ensure the specified sequence of the process steps.

3. Method according to claim 1, wherein before final assembly at the finishing location, at least one of the modules is partially assembled at at least one installation location.

4. Method according to claim 2, wherein before final assembly at the finishing location, at least one of the modules is partially assembled at at least one installation location.

5. Method according to claim 3, wherein the installation location is an assembly hall or assembly room.

6. Method according to claim 1, wherein the finishing locations for at least two modules are identical.

7. Method according to claim 1, wherein for at least one of the assembled modules, the module is tested for functionality between the second and third steps.

8. Method according to claim 1, wherein during the third step, each module group is connected to at least one additional module group.

9. Method according to claim 1, wherein the finishing location is an assembly hall or assembly room.

10. Painting system according to claim 1, wherein each module has components which are specific to the module.

11. Painting system according to claim 10, wherein for at least one module of each module group a distinct component is provided in the form of a container, wherein the container has an interior space in which additional distinct components of the module are installed.

12. Painting system according to claim 11, wherein the interior space is delimited by container walls, and in at least one container wall at least one passage opening is provided for the passage of at least one line which extends from the interior to outside the container.

13. Painting system according to claim 11, wherein the distinct components are installed inside the container according to a specified component plan.

14. Painting system according to claim 10, wherein for at least one module of each module group a number of the distinct components are provided in the form of electrical and/or pneumatic and/or hydraulic and/or data processing and/or fluid-conducting components which form an infrastructure which is specific to the module group.

15. Painting system according to claim 14, wherein connecting means are provided which are designed to connect the infrastructure of one module group to the infrastructure of at least one additional module group.

16. Painting system according to claim 1, wherein transfer means are provided which are designed to transfer energy and/or media and/or signals and/or data between at least two module groups.

17. Painting system according to claim 1, wherein the painting system has seven module groups, comprising a module group which may be used as a washing zone, a module group which may be used as a paint booth, a module group which may be used as an evaporation zone, a module group which may be used as a drying zone, a module group which may be used as a cooling zone, a module group which may be used as an inspection zone, and a module group which may be used as a postprocessing zone.

18. Method according to claim 1, wherein in the first step, each module of the module group is completed at the respective finishing location that is spatially distinct from the setup location.

19. Painting system for painting components by use of a painting process which includes at least one process step, the painting system comprising at least one module group which is provided for the process step, the module group having a specified number of modules which are functional for their particular purpose and which are specific to the module group, and which contribute to performing the process step, and wherein further, one module group is a paint booth module group.

20. Painting system according to claim 19, wherein the painting process comprises multiple process steps which are carried out according to a specified sequence, and the painting system comprises multiple module groups, wherein each module group is provided for at least one of the process steps, and the module groups are connected to one another to ensure the specified sequence of the process steps.

21. Painting system according to claim 19, wherein the modules of a module group are interconnected according to a module plan which is specific to the module group.

* * * * *